US007762467B2

(12) United States Patent
Thurgood et al.

(10) Patent No.: US 7,762,467 B2
(45) Date of Patent: Jul. 27, 2010

(54) METHOD AND APPARATUS FOR USE IN PACKAGING A SELECTED NUMBER OF CONTAINERS

(75) Inventors: Robin G. Thurgood, Marshall, MI (US); Brian C. Bowerman, Quincy, MI (US)

(73) Assignee: Rennco, LLC, Homer, MI (US)

( * ) Notice: Subject to any disclaimer, the term of this patent is extended or adjusted under 35 U.S.C. 154(b) by 0 days.

(21) Appl. No.: 12/024,800

(22) Filed: Feb. 1, 2008

(65) Prior Publication Data

US 2008/0184673 A1 Aug. 7, 2008

Related U.S. Application Data

(60) Provisional application No. 60/887,722, filed on Feb. 1, 2007.

(51) Int. Cl.

| | |
|---|---|
| ***G06K 13/00*** | (2006.01) |
| ***G06F 19/00*** | (2006.01) |
| ***G06Q 30/00*** | (2006.01) |
| ***G06Q 90/00*** | (2006.01) |

(52) U.S. Cl. ..... 235/475; 235/385; 250/223 R; 414/795.6; 414/797.2; 198/419.2

(58) Field of Classification Search ..... 235/98 C, 235/98 R, 475, 479, 385; 250/223 R; 414/795.6, 414/797.2, 788.2, 798.4; 198/419.2, 461.2, 198/462.1, 606; 53/445, 495, 54, 500, 542
See application file for complete search history.

(56) References Cited

U.S. PATENT DOCUMENTS

| | | | | |
|---|---|---|---|---|
| 3,313,482 | A * | 4/1967 | Midgley et al. | 235/98 R |
| 3,497,086 | A * | 2/1970 | Schnepp et al. | 414/798.4 |
| 3,661,282 | A * | 5/1972 | Buhayar et al. | 414/800 |
| 3,780,885 | A * | 12/1973 | Van Der Roer | 414/795.6 |
| 4,142,345 | A * | 3/1979 | Porter, Jr. | 53/54 |
| 4,545,714 | A * | 10/1985 | Johnson et al. | 414/788.2 |
| 4,927,319 | A * | 5/1990 | Montali | 414/788.4 |
| 5,095,684 | A * | 3/1992 | Walker et al. | 53/443 |
| 5,163,073 | A * | 11/1992 | Chasteen et al. | 377/8 |
| 5,704,194 | A * | 1/1998 | Niehaus | 53/415 |
| 6,267,550 | B1 * | 7/2001 | Morgan | 414/798.4 |
| 7,269,934 | B2 * | 9/2007 | Cremers et al. | 53/542 |
| 2005/0263952 | A1 * | 12/2005 | Campioli et al. | 270/58.1 |
| 2006/0131130 | A1 * | 6/2006 | Thurgood et al. | 198/416 |

* cited by examiner

*Primary Examiner*—Michael G Lee
*Assistant Examiner*—Suezu Ellis
(74) *Attorney, Agent, or Firm*—Thompson Hine LLP

(57) ABSTRACT

A container packaging machine includes a container handling and counting apparatus including an upstream accumulation portion and a downstream container separation and counting portion. The containers having a relatively tightly nested configuration as the containers move through the accumulation portion and having a relatively loosely nested configuration as the containers move through the container separation and counting portion where separation of the containers form distinct peaks and valleys for use in counting the containers.

15 Claims, 6 Drawing Sheets

METHOD AND APPARATUS FOR USE IN PACKAGING A SELECTED NUMBER OF CONTAINERS

CROSS-REFERENCE TO RELATED APPLICATIONS

This application claims priority to U.S. Provisional Application No. 60/887,722, filed Feb. 1, 2007.

TECHNICAL FIELD

The present application relates to packaging machines and more particularly to a packaging machine including a system for use in counting containers.

BACKGROUND

Cups are typically packaged for retail or commercial sale as nested stacks of cups. For example, it is not unusual to provide cups nested in single or multiple stacks such as two stacks (e.g., of 10 cups each for a total of 20 cups) within a plastic bag for retail sale, for example, in a grocery store, supermarket, gas station, etc.

Automated processes and machines have been provided to sort and arrange the containers into the nested stacks for packaging. Additionally, systems have been proposed for counting cups, usually relying on a pronounced lip or flange that can easily be detected, for example using a mechanical finger. Cups having relatively broad lips with somewhat constant outer diameters can be difficult to accurately count. What is needed is a system and apparatus for counting containers of various configurations.

SUMMARY

In an aspect, a container packaging machine includes a container handling and counting apparatus including an upstream accumulation portion and a downstream container separation and counting portion. The containers having a relatively tightly nested configuration as the containers move through the accumulation portion and having a relatively loosely nested configuration as the containers move through the container separation and counting portion where separation of the containers form distinct peaks and valleys for use in counting the containers.

The details of one or more embodiments are set forth in the accompanying drawings and the description below. Other features, objects, and advantages will be apparent from the description and drawings, and from the claims.

DETAILED DESCRIPTION

Figure 1:
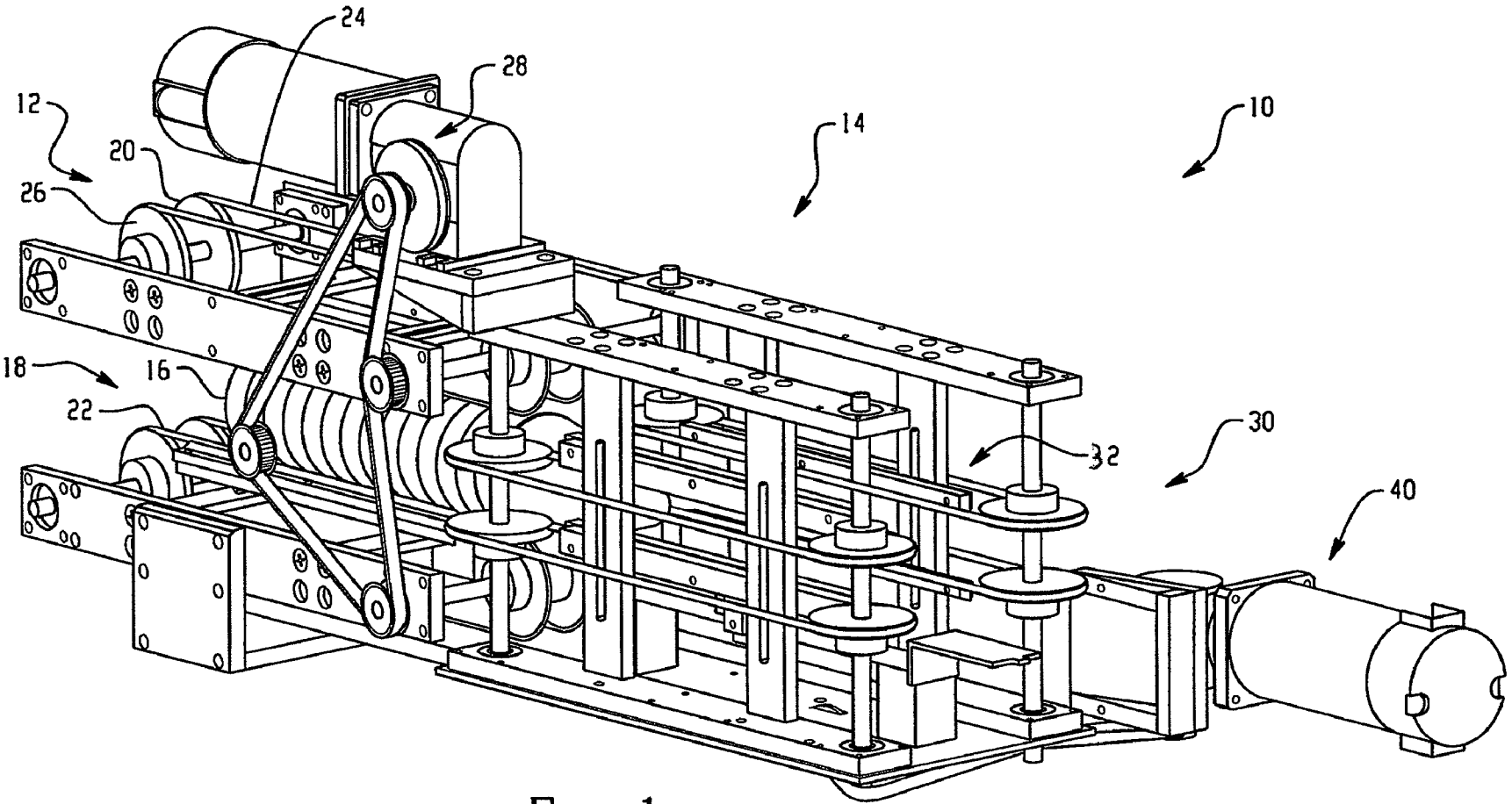
FIG. 1 is a perspective view of an embodiment of a container handling and counting apparatus.

Referring to FIG. 1, a container handling and counting apparatus 10 includes an accumulation portion 12 and a container separation and counting portion 14. Accumulation portion 12 may receive containers 16 from a source such as a container infeed (not shown) that provides a container path to the accumulation portion where the containers 16 are located for separating and counting operations.

Accumulation portion 12 includes an upstream conveyor system 18 that includes a first conveyor belt assembly 20 and an opposing conveyor belt assembly 22 that operate in unison to deliver the containers along a path toward the container separation and counting portion 14. The conveyor belt assemblies 20 and 22 each include belt members 24 that are driven by pulleys 26. In some embodiments, the belt members 24 are formed of an elastic material to apply a low amount of force to the containers 16. The pulleys 26 are operatively connected to a drive system 28 that drives the conveyor belt assemblies 20 and 22. In some embodiments, a controller (not shown) is used to control operation of the drive system.

Figure 6:
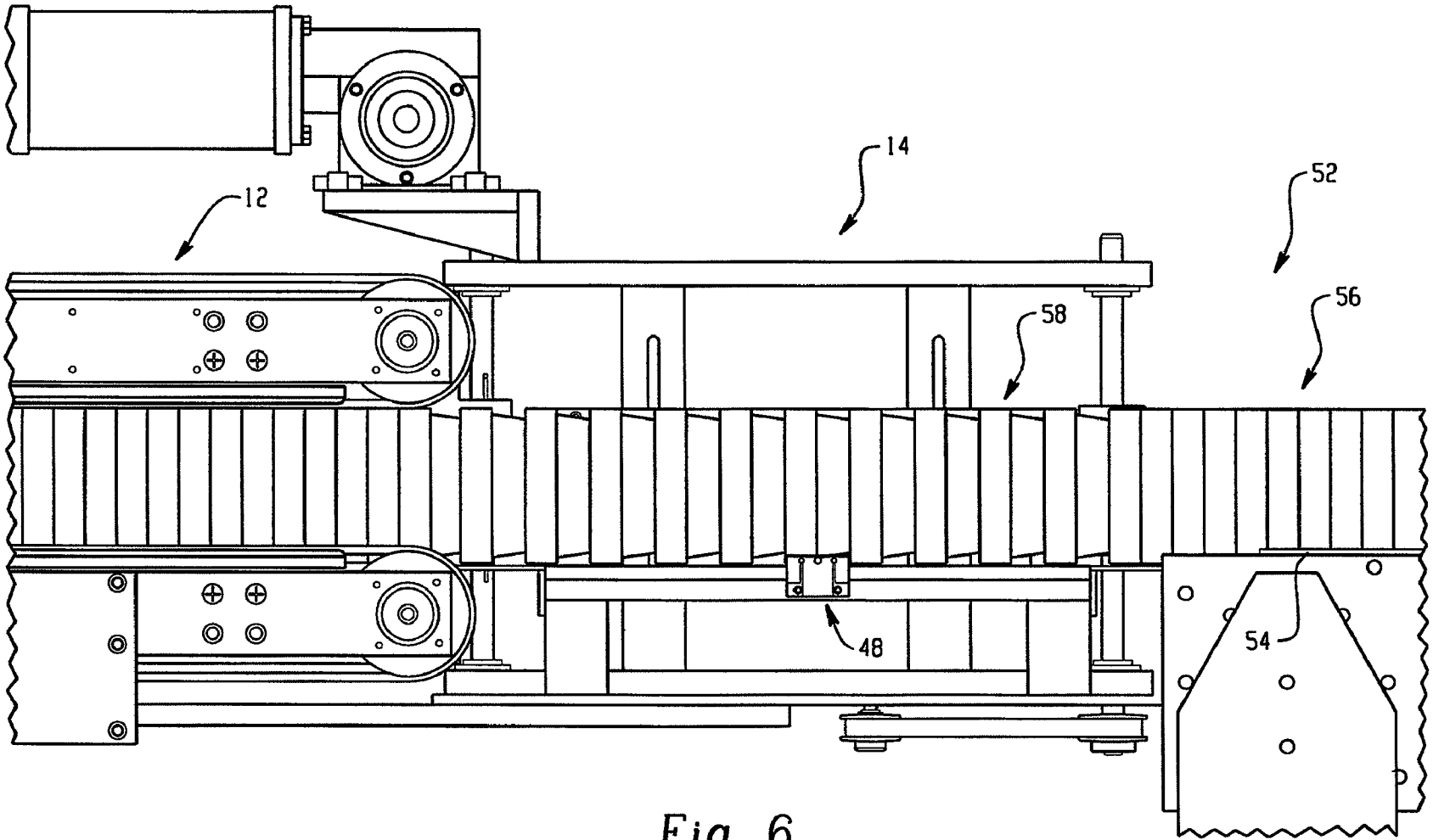
FIG. 6 is a side, detail view of the container handling apparatus of FIG. 1 feeding containers onto a packaging portion where the containers are again tightly nested and moved downstream.

The container and separation portion 14 includes a downstream conveyor system 30 that includes a first conveyor belt assembly 32 and an opposing conveyor belt assembly 34 that operate in unison to deliver the containers 16 along a path toward a downstream accumulation portion 52 (FIG. 6). The conveyor belt assemblies 32 and 34 each include belt members 36 that are driven by pulleys 38. As above, the belt members 36 may be formed of an elastic material to apply a low amount of force to the containers 16. The pulleys 38 are operatively connected to a drive system 40 that drives the conveyor belt assemblies 32 and 34 at a different velocity than that of the conveyor belt assemblies 20 and 22. In some embodiments, the controller (not shown) is used to control operation of the drive system 40.

Figure 2:
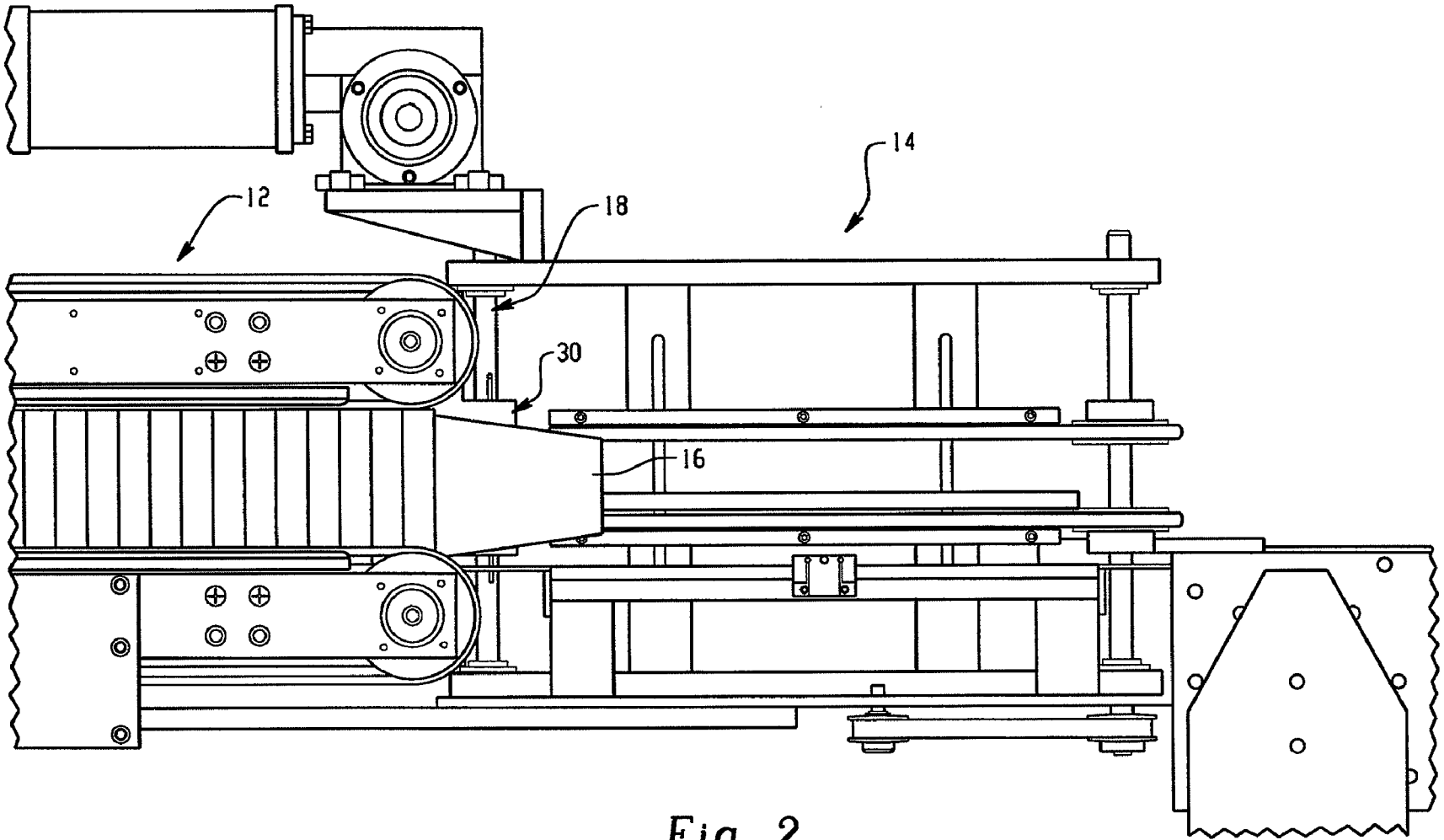
FIG. 2 is a side, detail view of the container handling apparatus of FIG. 1 showing an interface between an upstream accumulation portion and a downstream separation and counting portion.

Referring to FIG. 2, the containers 16 are typically directed from the accumulation portion 12 toward the container separation and counting portion 14 as a continuous stack 30 of containers 16, each container being nested with an adjacent container. The stack of containers 30 are driven at a first velocity using the upstream conveyor system 18 until each container 16 reaches the container separation and counting portion 14.

Figure 3:
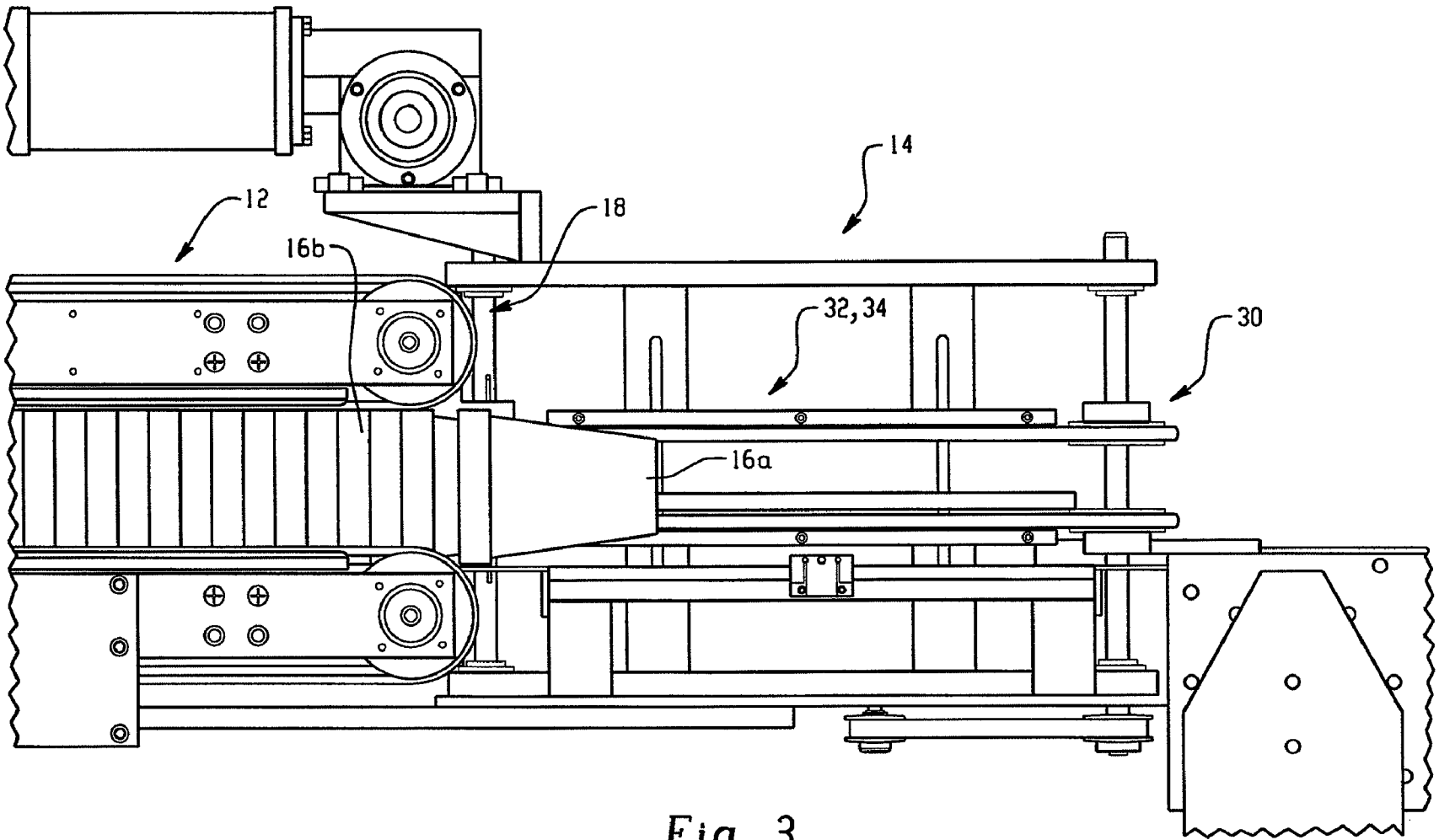
FIG. 3 is a side, detail view of the container handling apparatus of FIG. 1 showing a container being separated from an adjacent container using a conveyor system of the downstream separation and counting portion.

Referring now to FIG. 3, as noted above, the downstream conveyor system 30 operates at a velocity that is different that that of the upstream conveyor system 18. In this embodiment, the downstream conveyor system 30 operates at a higher velocity than the upstream conveyor system 18. As can be seen by FIG. 3, this difference in velocity provides separation between container 16*a*, which has been engaged between conveyor belt assemblies 32 and 34, and adjacent container 16*b*, which has yet to be engaged by conveyor belt assemblies 32 and 34.

Figure 4:
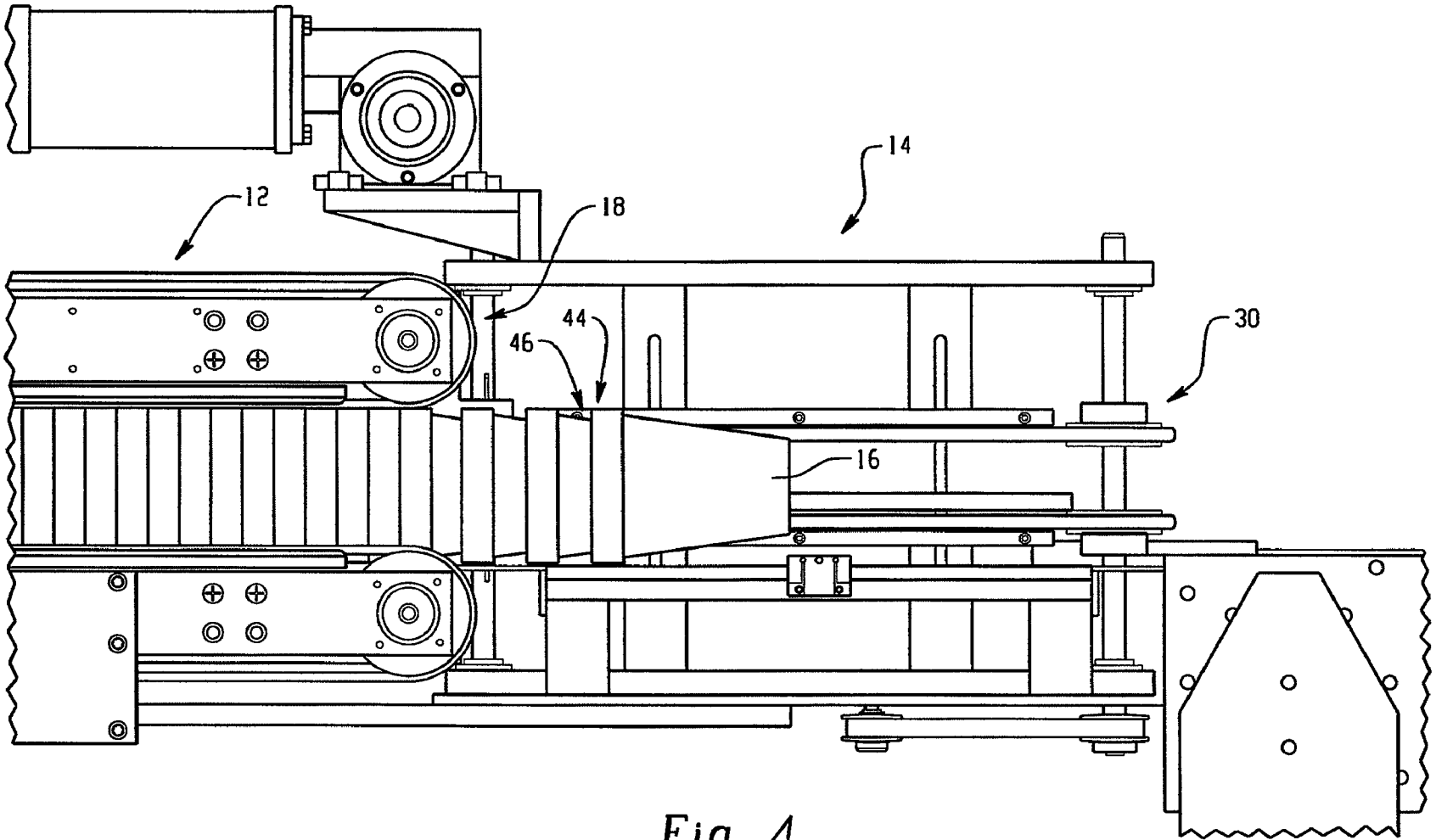
FIG. 4 is side, detail view of the container handling apparatus of FIG. 1 showing formation of a loosely nested stack of containers using the conveyor system of the downstream separation and counting portion.

Referring to FIG. 4, as each container 16 is initially engaged by the downstream conveyor system 30, it separates from its adjacent, upstream container until the adjacent, upstream container is also engaged by the downstream conveyor system. Once adjacent containers 16 are both engaged by the downstream conveyor system 30, the separation between the adjacent containers remains substantially unchanged as the containers move along the path within the container separation and counting portion 14.

In some embodiments, it is preferable that the containers 16 remain nested to (albeit separated slightly from) adjacent containers as they move through the container separation and counting portion 14. Maintaining a loosely nested configuration can facilitate downstream tightening of the nest of containers. In some embodiments, the downstream conveyor system 30 may be no more than about 7 percent, no more than 6 percent, no more than 5 percent, no more than 4 percent, between about 3 percent and about 7 percent, between about 4 percent and about 6 percent, such as about 5 percent faster than the velocity of the upstream conveyor system 18 in order to maintain nesting of the stack of containers 16. As can be appreciated, the container handling and counting apparatus 10 moves containers 16 having a first, tightly nested configuration through the accumulation portion 12 and having a second, loosely nested configuration through the container separation and counting portion. As can be seen by FIG. 4, once separated, the nest of containers 16 has relatively well-defined peaks 44 and valleys 46 that can be used in counting the containers.

Figure 5:
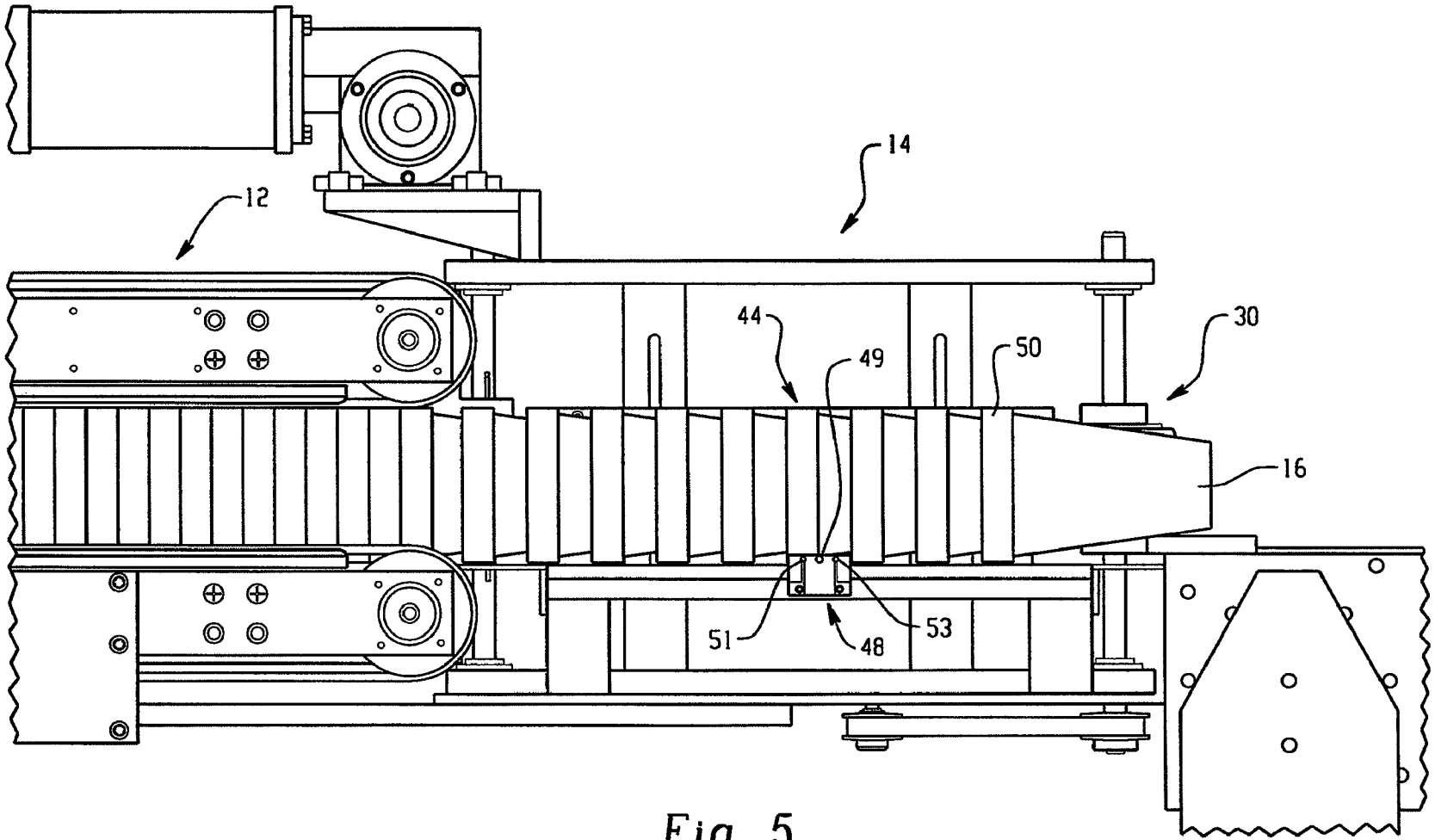
FIG. 5 is a side, detail view of the container handling apparatus of FIG. 1 showing the loosely nested stack of containers passing by a counting sensor for use in counting containers as they pass thereby.

Referring to FIG. 5, a sensor assembly 48 is located adjacent the container path so as to detect peaks 44 that are formed by lips 50 of the containers 16. In some embodiments, the sensor assembly 48 may be an optical detector system or other no-touch detector system. In the illustrated embodiment, the sensor assembly 48 includes both a counting eye 49 that is located between verification eyes 51 and 53, which are used to verify counts detected by the counting eye. The sensor assembly 48 is connected to a controller that tracks the number of containers 16 detected by the sensor assembly.

Referring to FIG. 6, the counted containers 16 are fed onto a second accumulation portion 52 where friction is used to place the containers in their tightly nested configuration. The second accumulation portion 52 includes a conveyor system 54 that may be, for example, stopped or moving relatively slowly as the counted containers 16 are fed thereon. In some embodiments, the second accumulation portion 52 may be a packaging station where the counted containers 16 are to be packaged as a tightly nested stack having a counted number of containers. Once a pre-selected number of containers 16 have been counted using the sensor assembly, the conveyor system 54 may quickly accelerate, separating a tightly stacked portion 56 of containers 16 from an adjacent, loosely stacked portion 58 of containers. In some embodiments, one or both of the conveyor systems 18 and 30 may stop or slow down once a pre-selected number of containers 16 are counted.

As can be appreciated, the above-described container handling and counting apparatus 10 can provide for reliable counting of containers for a packaging operation. The container handling and counting apparatus 10 may be particularly useful in packaging cups having relatively broad lips of substantially constant outer diameter, such as is common with Styrofoam cups. By loosening the nested cups, distinct peaks and valleys can be formed which can be used by, for example, an optical cup detector system to count the cups.

It is to be clearly understood that the above description is intended by way of illustration and example only and is not intended to be taken by way of limitation, and that changes and modifications are possible.

What is claimed is:

1. A container packaging machine, comprising:

a container handling and counting apparatus having:

an upstream accumulation portion, as containers move through the accumulation portion they are in a closely nested configuration;

a downstream separation and counting portion in which containers are shifted from the closely nested configuration to a loosely nested configuration such that a rim portion of the containers are spaced apart with the containers remaining nested to facilitate counting; and a downstream accumulation portion located downstream of the downstream separation and counting portion, the downstream accumulation portion receives the containers from the downstream separation and counting portion and places the containers in a closely nested configuration;

the upstream accumulation portion including a first conveyor system comprising a conveyor belt that moves the containers through the accumulation portion in the closely nested configuration;

the downstream separation and counting portion including a second conveyor system comprising a conveyor belt that receives the containers from the upstream accumulation portion and separates the containers, placing them in the loosely nested configuration and moves the containers through the downstream separation and counting portion in the loosely nested configuration;

the downstream accumulation portion including a third conveyor system comprising a conveyor belt that receives the containers from the downstream separation and counting portion and places the containers in a closely nested configuration;

wherein the conveyor belt of the second conveyor system moves faster than the conveyor belts of the first and third conveyor systems such that the containers are placed in the loosely nested configuration when moving from the first conveyor system to the second conveyor system and are placed in the closely nested configuration when moving from the second conveyor system to the third conveyor system.

2. The machine of claim 1 wherein profiles of the loosely nested containers form distinct peaks at the rim portions and valleys at container wall portions to facilitate counting.

3. The machine of claim 1 wherein the second conveyor system is no more than about 7 percent faster than the velocity of the first conveyor system.

4. The machine of claim 1 further comprising a sensor assembly located at the downstream separation and counting portion that detects the containers as they pass thereby in their loosely nested configuration by detecting the rim portions of the containers.

5. The machine of claim 4 further comprising a controller that tracks a number of containers detected using the sensor assembly.

6. The machine of claim 1 wherein once a predetermined number of containers have been counted and delivered to the downstream accumulation portion, a controller instructs the downstream accumulation portion to separate the predetermined number of containers from the remaining containers.

7. A method of packaging containers, comprising:

(a) conveying containers in a closely nested configuration through an upstream accumulation portion of a container handling apparatus;

(b) separating the containers to a loosely nested configuration where rim portions of adjacent containers are separated when they are conveyed through a downstream separation and counting portion of the container handling apparatus for facilitating counting of the containers, adjacent containers substantially maintaining their loosely nested configuration during their travel through the downstream separation and counting portion without moving relative to each other;

(c) counting the containers passing through the downstream separation and counting portion as the containers remain in their loosely nested configuration; and (d) renesting the containers to a closely nested configuration only after the containers have been counted, wherein the step of conveying the containers in the closely nested configuration through the upstream accumulation portion of the container handling apparatus includes using an upstream conveyor system and the step of separating the containers to the loosely nested configuration includes using a downstream conveyor system of the downstream separation and counting portion that is arranged and configured to receive containers from the upstream conveyor system; and operating the upstream conveyor system at a slower velocity than the downstream conveyor system to provide separation between adjacent containers as they are engaged by the downstream conveyor system.

8. The method of claim 7 wherein in the loosely nested configuration container profiles form distinct peaks at the rim portions and valleys at container wall portions to facilitate counting.

9. The method of claim 8 further comprising detecting the peaks at the rim portions using a sensor assembly.

10. The method of claim 9 further comprising counting the containers using a controller connected to the sensor assembly.

11. The method of claim 7 further comprising placing the containers in a closely nested configuration at a downstream accumulation portion located downstream of the downstream separation and counting portion.

12. The method of claim 11 further comprising separating a predetermined number of containers at the downstream accumulation portion from the remaining containers after counting the containers at the downstream separation and counting portion.

13. The method of claim 7, wherein the containers remain nested throughout steps (a)-(d).

14. The method of claim 13, wherein the containers are cups.

15. A method of packaging containers, comprising:

(a) conveying containers in a closely nested configuration through an upstream accumulation portion of a container handling apparatus using an upstream conveyor system, each container having a rim portion and a tapered container wall portion extending therefrom to an end of the container;

(b) separating the containers to a loosely nested configuration where rim portions of adjacent containers are separated by valley spacings when they are conveyed by a downstream conveyor system through a downstream separation and counting portion of the container handling apparatus for facilitating counting of the containers, adjacent containers substantially maintaining their loosely nested configuration during travel through the downstream separation and counting portion such that at least a portion of the tapered container walls overlap in the loosely nested configuration;

(c) counting the containers passing through the downstream separation and counting portion as the containers remain in their loosely nested configuration, the counting utilizing an optical sensor assembly with a detector located in position above the valleys but below the rim portions to detect the presence of rim portions moving thereby; and (d) renesting the containers to a closely nested configuration only after the containers have been counted, wherein the upstream conveyor system used in step (a) is operated at a slower velocity than the downstream conveyor system used in step (b).

* * * * *